United States Patent [19]

Britt et al.

[11] 4,396,865

[45] Aug. 2, 1983

[54] THERMINOIC FAULT CURRENT LIMITER AND METHOD OF CURRENT LIMITING

[75] Inventors: Edward J. Britt, Cupertino; Gary O. Fitzpatrick, Livermore; Lorin K. Hansen, Fremont; Mario Rabinowitz, Redwood City, all of Calif.

[73] Assignee: Electric Power Research Institute, Inc., Palo Alto, Calif.

[21] Appl. No.: 288,354

[22] Filed: Jul. 30, 1981

[51] Int. Cl.[3] ..... H01J 7/44

[52] U.S. Cl. ..... 315/36; 315/94; 315/111.01; 315/189; 315/363

[58] Field of Search ..... 315/36, 111, 111.2, 315/189, 190, 248, 324, 340, 362, 363, 94, 96; 361/58, 120

[56] References Cited

U.S. PATENT DOCUMENTS

| | | | |
|---|---|---|---|
| 1,655,972 | 1/1928 | Pineles | 315/36 |
| 2,370,082 | 2/1945 | Slepian | 361/120 |
| 3,119,040 | 1/1964 | Gardiner et al. | 361/120 |
| 3,382,402 | 5/1968 | Lafferty | 315/36 |

*Primary Examiner*—Harold A. Dixon

*Attorney, Agent, or Firm*—Flehr, Hohbach, Test, Albritton & Herbert

[57] ABSTRACT

A thermionic fault current limiter utilizes either a vacuum or plasma environment for a plurality of spaced conduction electrodes. The electrode can be supported by insulative spacers with the electrode providing shadow shields for the supporting spacers. Electrode spacing, power density, temperature gradients, and control grids can be utilized for optimum operation and in establishing self-absorption of energy for a desired operating environment. Cesium desorption from the electrode surfaces can be utilized to enhance current termination.

22 Claims, 17 Drawing Figures

RATIO OF MAXIMUM VOLTAGE TO INITIAL SURGE VOLTAGE AS A FUNCTION OF ELECTRODE SPACING

I-V CHARACTERISTICS SHOWING CURRENT CUT-OFF OF A LOW PRESSURE DIODE

I-V CHARACTERISTICS SHOWING CURRENT CUT-OFF IN A LOW PRESSURE TRIODE

PRESSURE VS. CURRENT CUT-OFF IN A LOW PRESSURE PLASMA DIODE

THERMINOIC FAULT CURRENT LIMITER AND METHOD OF CURRENT LIMITING

BACKGROUND OF THE INVENTION

1. Field of the Invention

This invention relates generally to fault current limiters in electric power systems, and more particularly the invention relates to apparatus and methods for limiting fault currents in power line transmission and distribution networks by means of thermionic vacuum and plasma discharge processes.

2. Description of the Prior Art

An electric power utility systems have grown in the past decade, the need has developed for a device to keep the potentially excessively high fault current within the ratings of existing equipment such as transformers and circuit breakers. To date there is no known commercially available fault current limiter. Known devices have been either technically or economically unsuccessful.

Such devices have fallen into two broad categories. In the first category a tuned circuit in which the inductive reactance essentially cancels the capacitive reactance is used in series in a power line to give a low impedance at the power frequency. When a fault (i.e. short circuit) occurs, a switch shorts out the capacitor, and the inductive reactance limits the current. Disadvantages include large size, big initial capital cost, and high operating costs.

In the second category, an impedance in parallel with a normally closed bypass switch is placed in series in the power line. When a fault is sensed, the bypass switch is opened and a current is transferred to the current limiting impedance. The approaches tried have included unstable vacuum arcs controlled by a magnetic field or other high arcing voltage circuit breakers in parallel with resistors; switches in parallel with fuses and resistors; and driving superconductors into a highly resistive state. Some of the disadvantages are related to the difficulty in switching and slow response because of the time required for sensing and switching operations.

OBJECTS AND SUMMARY OF THE INVENTION

An object of the present invention is enhanced operation of a fault current limiter.

Another object of the invention is a thermionic fault current limiter which can reduce overload current to zero.

Yet another object of the invention is improved operational lifetime of thermionic fault current limiters.

Another object of the invention is reduction in size and weight and increase in operating efficiency of a fault current limiter.

Still another object of the invention is lower capital and operating costs and increased operating reliability of current limiters in power applications.

Another object of the invention is the extended range and lifetime and/or reduced overload demands and costs required for ancillary power equipment when protected by a fault current limiter.

Another object of the invention is the provision of the option of eliminating a separate sensing device and bypass switch by using a current limiter in-line.

A further object of the present invention is a fault current limiter for reducing overload current to zero thereby eliminating the necessity for circuit breakers.

Yet another object of the invention is means for limiting fault current through limitations in electron and/or ion emission at the electrodes inclusive of thermionic or secondary processes due to electron, ion or photon bombardment.

Another object of the invention is the limiting of fault current by increased device impedance because of instabilities and oscillations in sheaths and plasmas and by limited ion space charge neutralization at electrodes or grid apertures.

Still another object of the invention is the limitation of current through the altering of the emission capabilities of the electrodes.

Briefly, a current limiter in accordance with the invention comprises a housing, a plurality of conductive electrodes, and means for insulatively supporting the plates in the housing in generally spaced parallel alignment. A first electrical conductor is insulatively mounted through the housing and in contact with the first of the electrodes, and a second electrical conductor is insulatively mounted through the housing and in contact with the last of the electrodes.

In accordance with one feature of the invention, the plates are maintained in a vacuum environment and the spacing of the plates is selected for a maximum voltage so that the emission limited current value will not increase by more than a factor of two.

In accordance with another feature of the invention, control grids are placed between the conductive plates with biasing means provided for the grids whereby electron emission can be further controlled.

In accordance with another preferred embodiment of the invention thermionic electron emission is controlled by providing a plasma for neutralizing the emitted electrons. Thus, the impedance of a thermionic fault current limiter is controlled by the presence of the plasma. By proper selection of the plasma material, the work functions of the electrodes in the current limiter can be reduced by the absorption of the plasma generating material at the surface of the electrodes. In this embodiment the vaporizable plasma generating material is provided in a reservoir within the housing, and heater means is provided for heating the electrode and vaporizing the materials.

A current of thermionic emitted electrons is permitted to flow between the electrodes by the positive ions in the plasma which neutralize the space charge under fault limiting conditions. The amount of current is constrained by the point at which all or a maximum of the atoms in the low pressure plasma become ionized and thus no further negative electron space charge can be neutralized. Fault current is thus conducted by both electrons drifting from the negative electrodes to the positive electrodes and positive ions flowing from positive electrodes to the negative electrodes and is sharply limited.

The invention and objects and features thereof will be more readily apparent from the following detailed description and appended claims when taken with the drawing.

DETAILED DESCRIPTION

OVERVIEW

Figure 1A:
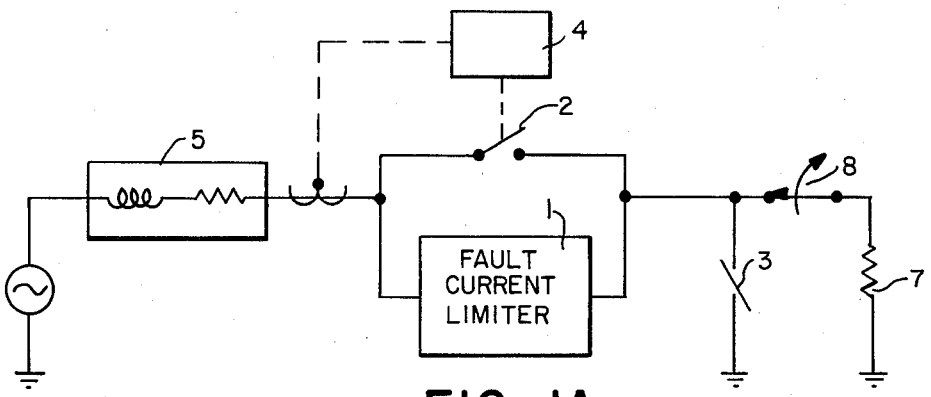
FIG. 1*a* is a schematic diagram of a fault current limiter utilizing a sensor and bypass switch in a power line circuit.
Figure 1B:
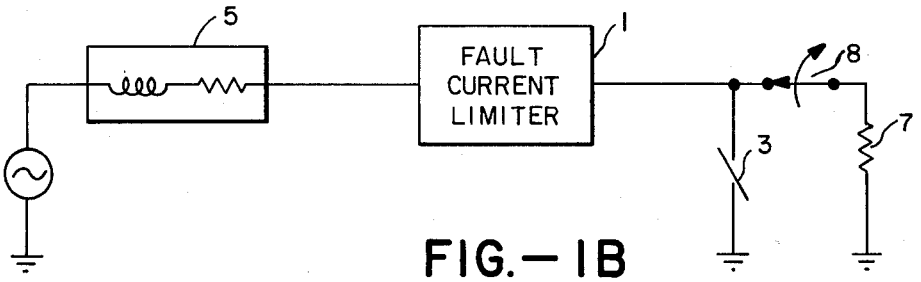
FIG. 1*b* is a schematic diagram showing a fault current limiter without sensor or bypass switch operating in-line in a power line circuit.

The present invention encompasses methods and apparatus for limiting a fault current in an electric power line by providing any of a variety of vacuum or plasma thermionic devices. The fault current limiter (FCL) can operate in either of two ways. As shown in FIG. 1*a* a current limiting device 1 in parallel with a bypass switch 2 is inserted into the power line. When a fault 3 is sensed by the sensor 4 the switch 2 is opened and the current transfers to the current limiter until circuit breakers 8 further down the line can open. In this case the current limiter must accept the full current with a minimum voltage across the switch, and then limit the current peak to an acceptable level when the peak power line voltage is developed across it. In a second approach, FIG. 1*b*, the FCL 1 operating normally has low enough internal impedance that is can remain permanently in line. Thus, when the fault 3 occurs the FCL acts immediately to limit the current and sustain the full line voltage without the delay of sensing and switching. In either case, it is possible that the limiter may not only limit the current under fault conditions, but also automatically or by control reduce the fault current to low values or even zero.

Described first hereinbelow is an illustrative embodiment of an FCL in accordance with the invention. Considered next are the operating limits for a vacuum fault current limiter as determined by Child-Langmuir space charge limits and the limits of Schottky emission. The plasma thermionic fault current limiter, which incorporates additional physical processes to make FCL's even more attractive, is then described. These additional processes increase the effectiveness and practicality of the plasma FCL over the vacuum device. Next, these FCL features which allow the FCL to operate as an in-line device and those features which permit the opening of the circuit as well as limiting the current by the device are discussed. This could eliminate the need for separate breakers or increase the lifetime of present breakers. Finally, experimental results obtained from reducing the device to practice are presented.

ILLUSTRATIVE EMBODIMENT

Figure 2A:
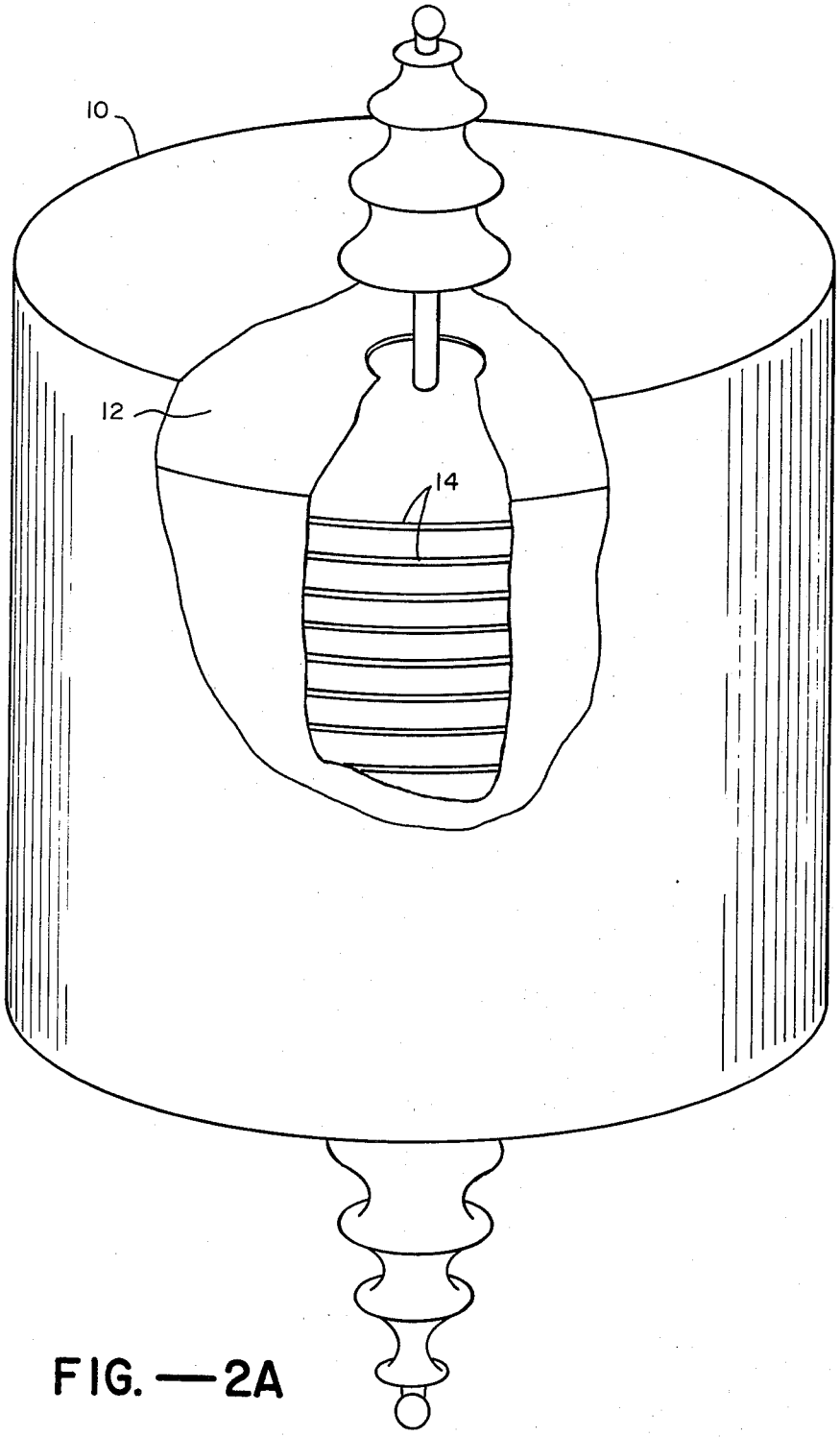
FIG. 2*a* is a cut away view of a plasma thermionic fault current limiter.
Figure 2B:
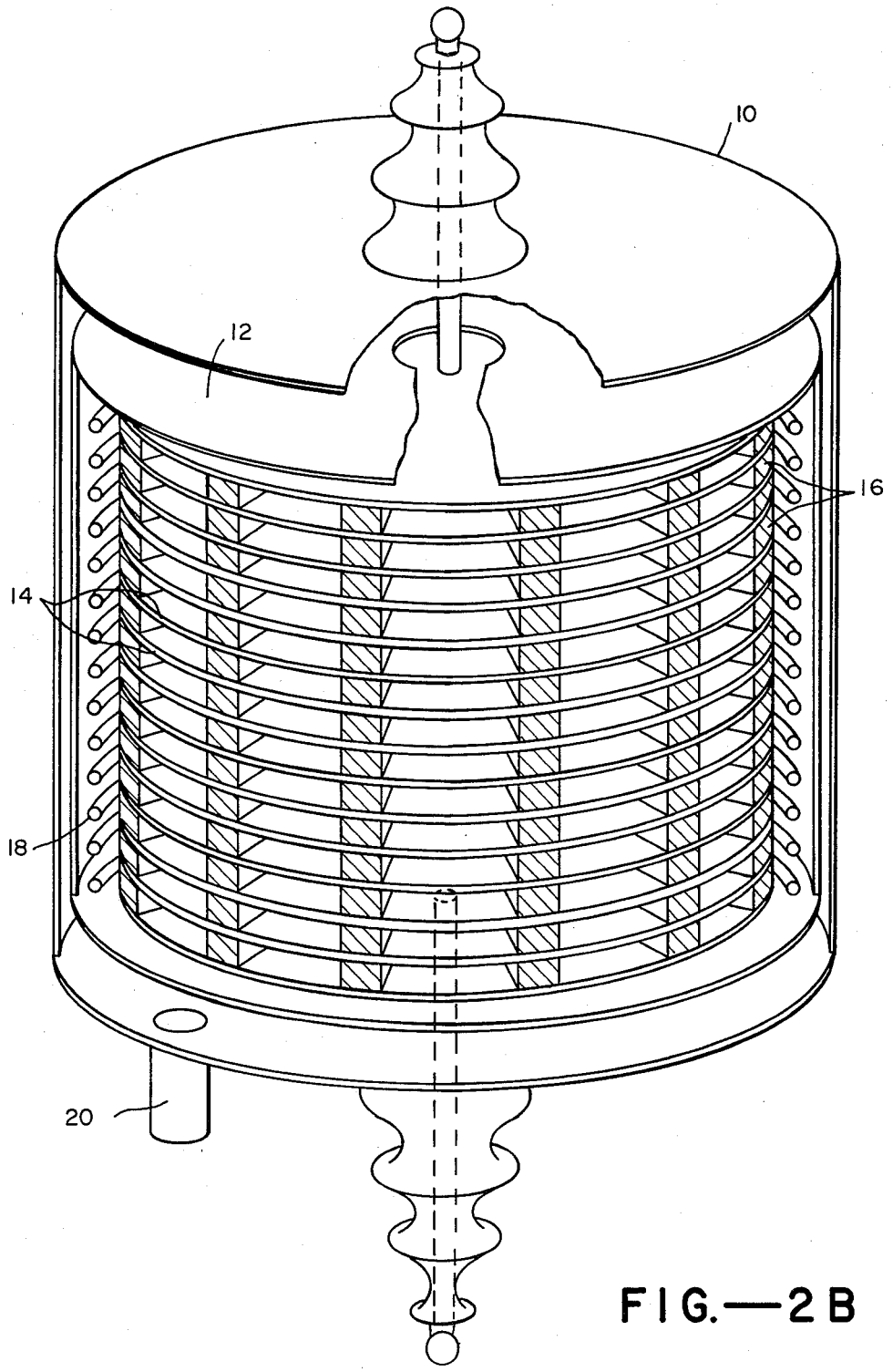
FIG. 2*b* is a cross-sectional view of a plasma thermionic fault current limiter.

The fault current limiter can be constructed in various shapes and configurations. FIG. 2*a* shows an exploded view of a bi-polar (current conducted and limited in both directions) plasma thermionic fault current limiter 1 with stacked plane parallel plates, and FIG. 2*b* is a cross-sectional view of this device.

The device includes a housing 10, a radiation shield 12 positioned within the housing 10 for minimizing heat loss, and a plurality of conductive plates or electrodes 14. The plates 14 are supported in generally spaced parallel alignment by means of insulated spacers 16 between adjacent plates to provide a vacuum or plasma filled space between the electrode plates 14. Heater coils 18 surround and heat the plates 14 to induce thermionic emission.

The electrodes can be made of any metal whose melting point is above 700° C. such as tungsten, molybdenum, niobium, rhenium and nickel. The emitting surfaces may be grooved to increase their emitter capacity. For dispenser electrodes, the refractory material may be sintered so the dispensing material can be loaded in the porous electrode.

For the plasma device a reservoir 20 for liquid cesium, for example, and having separate temperature control can be used to control the cesium vapor pressure. Alternatively, an integral cesium reservoir e.g., cesium loaded graphite or graphite with interlaminar infusion (intercalation) of cesium, can be mounted in the region of the electrode stack, 14. The integral reservoir operates at the electrode temperature but maintains a vapor pressure comparable to that of a liquid reservoir at a lower temperature. The advantage of the integral reservoir is simplicity, since it is not necessary to separately control the temperature of the liquid reservoir. However, since the electrode temperature and the cesium pressure are coupled with an integral reservoir, greater operating flexibility is available with a liquid reservoir since the electrode temperature and cesium vapor pressure can be independently controlled and optimized. The temperature of all components and the chamber walls are operated above the condensation of cesium at the operating pressure. The amount of cesium required in the cesium reservoir (liquid or integral) is very small since there is no net consumption of cesium during operation. A single cesium reservoir (liquid or integral) can supply vapor for all of the electrodes, if small communicating passages are provided between the electrodes.

The insulators 16 can be of various materials, for example alumina, magnesia, thoria, beryllia, and yttria. Any of these can withstand cesium attack at elevated temperatures (1000°–1200° K.). Insulators containing silica in significant amount (greater than 2–3%) may be used in vacuum devices, but are not appropriate for cesium devices since cesium attacks silica above 200° C. Some of these materials such as yttria and thoria are too expensive. Beryllia is slightly expensive and (in some forms) is toxic. Magnesia does not have good high voltage properties at high temperatures. Therefore, high purity (greater than 97%) alumina is a preferred material for the insulators 16.

For initial operation (from a cold start) the device is heated with heating elements 18 until the electrodes are raised to the emission temperatures (600°-900° C.). The temperature of the plates can be uniform, or alternatively a temperature gradient can be established between the plates. The power source for this initial heating may be an auxiliary power source or the line voltage of the power grid. Once in operation, if the device is placed fully or partially in-line, the current passing through the device itself may be enough to maintain it at operating temperature; in which case, the heating elements 18 may be turned off.

During typical operation of a cesium FCL, the cesium pressure will be maintained in the range of $10^{-5}$ to 1 torr with $10^{-5}$ $10^{-3}$ preferred to minimize electrical breakdown problems. The broader range entails an atom density of about $3\times10^{11}$-$3\times10^{16}$ atoms/cm$^3$ or an arrival rate at the electrodes of about $10^{15}$-$10^{20}$ atoms/cm$^2$-sec. The design point depends on the particular device. This implies that the liquid cesium reservoir temperature $T_R$ would be in the range of 350° K. to 550° K. Everything else in the system will be kept hotter than this by the heater elements 18 or by internal power loss. The work function of the electrodes will be about 1.4 eV to 2.5 eV. The work functions may be maintained by cesium adsorption on the surfaces, or by adsorbed barium or strontium metal or compounds supplied by a dispensate from the electrodes or a vapor from a separate reservoir. Emission current densities in the range $10^{-2}$ to 1 A/cm$^2$ are obtained by operating the FCL electrodes 850° K. to 1200° K.

VOLTAGE CONSTRAINTS FOR A VACUUM FCL

A critical constraint on any fault current limiter is the ability to conduct the normal current at low voltages (important both for low in-line losses and efficient bypass switching) combined with the ability under fault conditions to withstand the full voltage of the system with only a limited increase in current. The multiple-electrode, bi-polar, plasma thermionic fault current limiter in accordance with one embodiment of this invention provides these requirements, but consider first the vacuum device.

In the absence of a plasma, a device utilizing thermionic emission is controlled by two fundamental processes: (1) space charge limited current at low applied voltages, and (2) emission limited current with associated Schottky effects at high voltages. At low voltages, electrode spacing must be small enough to allow the desired current, as determined by the Child-Langmuir law:

$$J \leqq \frac{4\epsilon_o}{9}\left(\frac{2e}{m}\right)^{\frac{1}{2}}\frac{(V_s/N)^{3/2}}{d^2} \quad (1)$$

As the voltage increases this current increases because of the Schottky effect:

$$J \leqq AT^2 \exp\{-[\phi - e(eE)^{\frac{1}{2}}]/kt\}. \quad (2)$$

where in mks units:

J is the current density.

$\epsilon_o$ is the permittivity of free space.

e is the charge of an electron.

m is the mass of an electron.

$V_s$ is the initial surge voltage when the device first starts to limit the fault current.

N is the number of cells (electrode pairs) in series in the device.

d is the interelectrode spacing.

A is a constant characteristic of the emitting surface.

T is the absolute temperature of the emitter, ~1200° K.

$\phi$ is the work function of the emitter.

E is the electric field at the emitter.

k is the Boltzmann constant.

These two inequalities or constraints define a range of electrode spacings. If we limit the current increase at the maximum voltage $V_m$ to within a factor F over the emission limited value at the voltage $V_s$ where space charge is just removed we have the following constraint on d:

$$\frac{V_m/N}{7\times10^6(\ln F)^2} \leqq d \leqq \left[\frac{2.33\times10^{-6}(V_s/N)^{3/2}}{J}\right]^{\frac{1}{2}} \quad (3)$$

Figure 3:
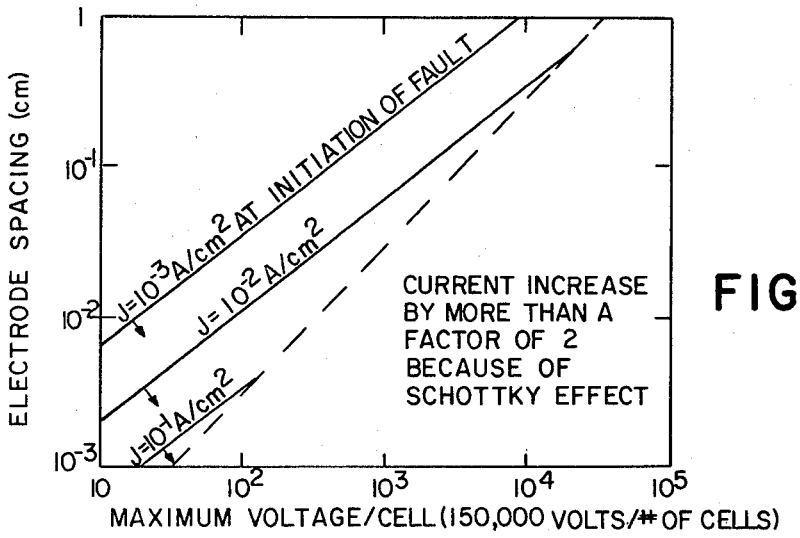
FIG. 3 is a plot showing design limitations on a vacuum thermionic fault current limiter.

FIG. 3 shows these results graphically for current densities at initiation of fault of $10^{-3}$, $10^{-2}$, and $10^{-1}$ A/cm$^2$ for the special case of $V_s$=1000 V and $V_m$=150 kV. This graph shows that the above inequality can be satisfied for this case at reasonable current densities (e.g. J=0.03 A/cm$^2$) for a large number of cells (150 kV/1 kV/cell=150 cells) and at close spacings (d≦0.02 cm).

The above inequality can also be satisfied for this case, using a smaller current density (e.g. J=0.01 A/cm$^2$), for a fewer number of cells (150 kV/3×10$^4$ kV/cell=5 cells) and at larger spacings (d≦0.8 cm). Thus, for the vacuum case one must use a large number of closely spaced cells or a few cells at high voltage per cell, but at very low current density. Both options are feasible and thus a range of practicality is established.

Another approach to the definition of FCL parameters is not to set $V_m$ and $V_s$ and ask what J, d and N are required, but to choose a J dictated by available emitters and heat absorption limits and a d which is practical and ask what $V_m/V_s$ is possible. A maximum voltage standoff $V_m$, and a minimum saturation voltage $V_s$ (for line operation or for switching) is desired. Therefore a maximum $V_m/V_s$ is desired. If this parameter is too low, then if diode parameters are chosen to remove space charge limitations at low enough voltages for inline operation or efficient bypass switching, then Schottky enhancement of the current becomes excessive at too low a voltage for power system application. This aspect of the limitation can be seen as follows. The current density at the onset of space charge limitation is given for plane-parallel electrodes by the Child-Langmuir law, which can be rewritten $$J = 2.33\times10^{-6}\left(\frac{V_s}{N}\right)^{3/2} d^{-2} \quad (4)$$

The Schottky multiplication of current, F is $$F = \frac{J_m}{J_o} = \left[\exp \frac{4.4}{T}\left(\frac{V_m}{Nd}\right)\right]^{\frac{1}{2}}, \quad (5)$$

where:

$J_m$ is the current density in A/cm$^2$ when a total maximum voltage $V_m$ is expressed across N unit cells in series.

T is the temperature of the cathodes in °K.

$J_o$ is the current density in A/cm$^2$ at the onset of Schottky emission.

Combining equations (4) and (5) we obtain:

$$\frac{V_m}{V_s} = 9.08 \frac{(\ln F)^2}{J^{\frac{3}{2}} d^{\frac{1}{2}}}\left(\frac{T}{10^3}\right)^2. \quad (6)$$

Figure 4:
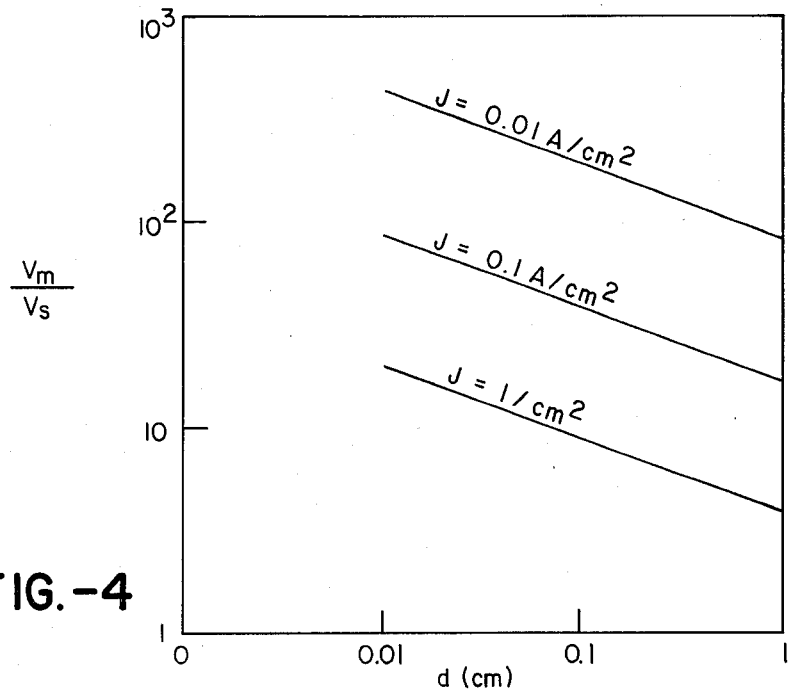
FIG. 4 is a plot of the ratio of maximum voltage to initial surge voltage as a function of electrode spacing and initial current density.

Equation (6) is independent of the number of cells N. The results of equation (6) are plotted in FIG. 4 for J=0.01, 0.1, and 1 A/cm$^2$ and T=1000° K. For the typical values d=0.1 cm, J=0.1 A/cm$^2$, and $F=J_m/J_o=2$, we see from FIG. 4 that $V_m/V_s=43.5$.

This means that at current densities dictated by heat transfer or heat capacity, and spacings dictated by practicality, a $V_m/V_s=43.5$ is available, independent of the number of cells needed. Thus, if the device is to standoff 15 kV ($V_m$=15 kV) the voltage drop for in-line operation or at switching into the circuit would be $V_s \doteq 345$ V.

POWER DENSITY CONSTRAINTS

The advantage of a series multicell structure is that the electrode material uniformly absorbs the energy during fault operation. No additional power dissipating element is needed. The ability of the FCL to accommodate the energy dissipated during the fault until the current is reduced to zero, however, places some constraints on the FCL power density. The FCL can be designed to uniformly absorb this energy in a multiple electrode structure; and the electrodes can be designed with appropriate number, mass, thickness, and operating current density so that the electrode temperature rise during fault is less than the maximum acceptable value. Uniformity of energy adsorption is assured in two ways: the uniformity of current density imposed by the interelectrode plasma and the feedback control implicit in the use of cesiated electrodes. In the latter case excessive energy dump in one area of an electrode, due to high current density will result in a local electrode temperature rise, a desorption of absorbed cesium, an increase in electrode work function and a consequent reduction in local current density.

The current densities that can be used in an FCL depend directly on the thermal load that such a device can be expected to handle. Consider that the FCL absorbs the fault power internally but need do this only for about 0.1 sec, that is, while the breaker is opening. Also, assume that the electrode temperature is to rise no more than 100° C. in this 0.1 sec, and assume that the electrodes in the device have the following typical specifications:

$$C_p = .05 \frac{\text{cal}}{\text{gm °C.}} \text{ (specific heat)}$$

-continued $$\rho = 10 \frac{\text{gm}}{\text{cm}^3} \text{ (density)}$$

$$t = 0.1 \text{ cm (thickness)}$$

The following relation can then be calculated $$J \cdot \frac{V}{N} \lesssim .05 \frac{\text{cal}}{\text{gm °C.}} \times 4.186 \frac{\text{W/sec}}{\text{cal}} \times 10 \frac{\text{gm}}{\text{cm}^3} \times \frac{0.1 \text{ cm}}{0.1 \text{ sec}} \times 100° \text{ C.} \quad (7)$$

where again J is the current density, V is the line to ground voltage (for a phase-to-ground fault), and N is the number of electrode cells in series in the FCL. Roughly, this gives $$J\frac{V}{N} < 200 \frac{\text{Watt}}{\text{cm}^2}. \quad (8)$$

Thus, an FCL should be designed so an electrode (of this thickness) will not receive more than about 200 W/cm$^2$ during fault operation.

Instead of letting the electrodes absorb the input energy so that the temperature rise is limited by limiting the period of energy input, the FCL could be designed for steady state operation and the temperature rise limited by limiting the input energy to a practical rate equal to what could be conducted away continuously. Limitations by conventional heat transfer (limited by nucleate pool boiling) would still limit heat input to the order of 200 W/cm$^2$, although more advanced heat pipe technology could do better.

Thus, whether one designs the FCL with simplicity, taking advantage of the fact that a fuse or breaker will open the circuit in 0.1 second, or designs the FCL so absorbed energy could be conducted away in steady state, the limitation on power input into the electrodes will be about the same $$J\frac{V}{N} < 200 \frac{\text{Watts}}{\text{cm}^2}. \quad (9)$$

The size and probably the cost of an FCL can be decreased for a given MVA capacity by decreasing the number of cells in series (increasing V/N) and by increasing the current density J. But the above relation means that there is a point where this design trend runs into electrical breakdown problems and thermal problems. Thus, if the number of cells is minimized to keep normal-operation, in-line voltage loss down (or equivalently, the bypass switching voltage down) there will be a high fault voltage per cell. Because of the above heat load limitation this in turn means that there will be a maximum in the current density that can be used. Thus, for about 2 kV/cell fault voltage this would be about 0.1 A/cm$^2$. Typical operation parameters would then be 1–2 kV/cell and 0.1–0.2 A/cm$^2$ FCL current. The FCL should be designed to operate near this maximum since lower current densities mean larger devices and therefore greater costs. Even higher fault power densities are acceptable to the extent higher temperature rises are acceptable. As described further hereinbelow the invention can cease conducting current of itself and this fast cut-off can hasten the time period of fault conduction and therefore allow even greater initial power densities.

CONSTRAINTS WITH PLASMA OPERATION

The power density constraint with the exceptions mentioned above applies to the plasma device as well as the vacuum device, but the space-charge, Schottky constraint applies to the vacuum device alone.

One of the simplest ways for removing space charge limitations in a diode is by introducing positive ions by generating a quasi-neutral plasma. By using a heavy ionic species the space charge can be neutralized with a relatively low plasma pressure. For example, if the species were cesium, an equilibrium vapor pressure of $10^{-4}$ Torr has about a $2\times10^{-3}$ A/cm$^2$ equivalent random current. If this were fully ionized, it could neutralize an electrode electron emission of $\sqrt{M/m}=492$ times this because of the mass difference, or about 1 A/cm$^2$. Such a vapor could be ionized to a high percentage if it was subjected to 0.1 to 0.3 A/cm$^2$ at 1000–2000 V as would be encountered in a FCL. The pressure $10^{-4}$ Torr is probably low enough that a FCL could hold off 1000–2000 V across the electrodes without developing a filamentary arc in the cesium vapor, especially with the gas close to full ionization already and the electrodes already heated to a temperature for uniform electron emission.

With plasma neutralization there is not the significant enhancement of electron emission from the Schottky effect as with the vacuum diode. This can be shown in a qualitative way as follows. In a discharge that depends on volume ionization the plasma potential attaches to the collector potential so that although there may be a small difference between these two, it stays about constant as the emitter to collector potential changes. This means that in a plasma neutralized FCL device the emitter to collector voltage will always be roughly equal to the emitter sheath drop. But the sheath field strength at the emitter is given by $$E \approx \sqrt{7.6\times10^5 J_p \frac{M}{m}\cdot f}\cdot V_E \qquad (10)$$

where E is the field strength in volts/cm, $V_E$ is the sheath height in volts, $J_p$ is the ion current from the plasma in A/cm$^2$ and M/m the ion to electron mass ratio. Thus, in a plasma diode, the electric field at the cathode is very large, but is very weakly dependent on the voltage applied to the device. It is more sensitive to the ion current to the cathode. But when a device reaches nearly 100% ionization even this dependence will be very weak. Thus when current enhancement occurs in an plasma-neutralized FCL it will be more the result of changes in the degree of ionization, transpiration, changes in the emitter temperature, or the effect that these have on the emitter work function.

FEATURES OF THE FCL PLASMA DEVICE

The conclusion from the preceding analysis is that even though a thermionic device without a plasma can function effectively as a fault current limiter, the addition of a plasma in the space between the electrode plates can greatly enhance the performance characteristics of the device. The plasma does so by neutralizing the electron space charge.

Figure 5A:
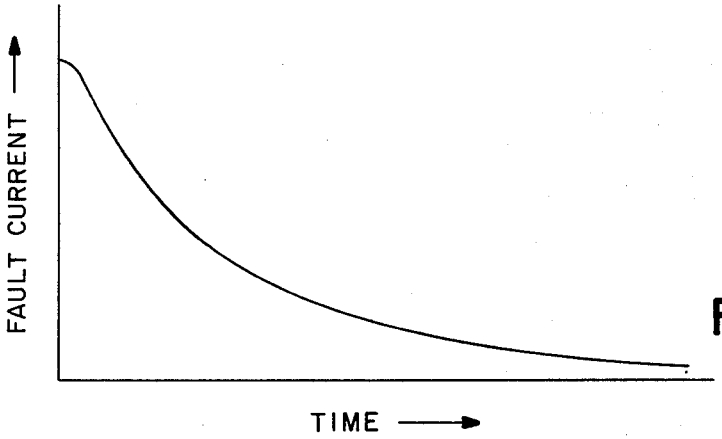
FIG. 5*a* is a plot of fault current versus time in response to desorption of a low work function surface layer.

In addition to limiting the fault current, a plasma thermionic device can serve to reduce the current towards zero in a circuit-breaking capacity. In contrast with ordinary circuit breakers, it can be expected to do so in a smooth, continuous fashion as shown in FIG. 5*a*. FIG. 5*a* shows the fault current decreasing as a function of time due to the desorption of the low work function surface layer leaving bare the high work function substrate. The increase in work function decreases the current.

Figure 5B:
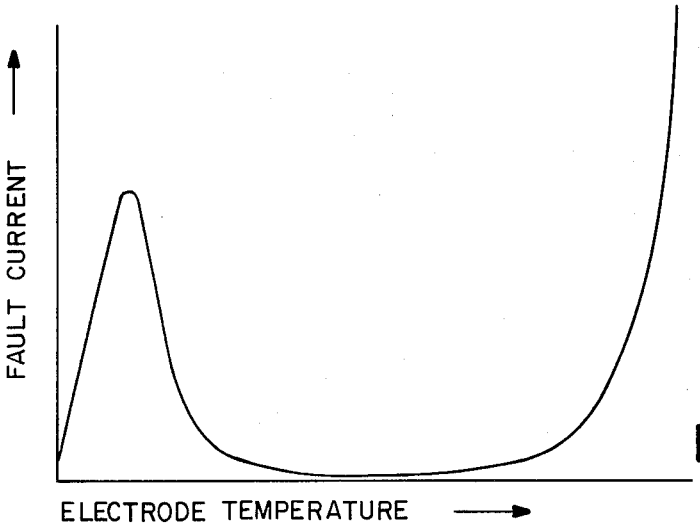
FIG. 5*b* is a plot of the fault current as a function of electrode temperature for metal vapor absorption on the electrode.
Figure 6:
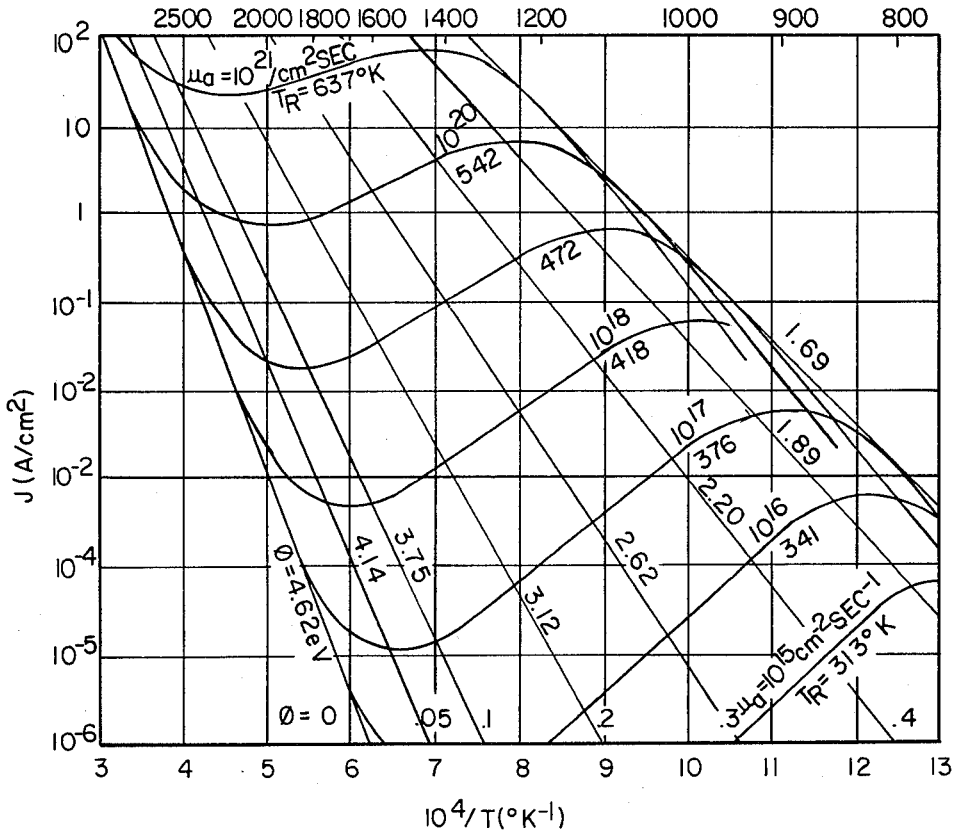
FIG. 6 is a plot of the electron emission current density versus temperature for cesium on tungsten, illustrating the effects of cesium adsorption.

It should be noted that the plasma, if it is cesium, cannot only neutralize the space charge, but as has been mentioned, also lower the work function of the electrodes by adsorption on the electrodes of the cesium vapor, thus increasing the emission capability of the electrodes for a given temperature. The enhanced emission with cesium in particular is also shown in FIG. 5*b*, where the temperature of the electrode is varied and the cesium vapor pressure is kept at $6.6\times10^{-3}$ Torr (corresponding to a cesium reservoir temperature of $T_R=418°$ K.). As this figure illustrates, at high temperatures the cesium vapor does not adsorb on the surface and the emission is that of the bare tungsten electrode, increasing with temperature according to the Richardson Dushman equation $$J = 120\,T^2 \exp\left(-\frac{\phi_o}{KT}\right)$$

where again T is the electrode temperature, $\phi_o$ is the work function of the bare surface and k is the Boltzmann constant. As the electrode temperature is lowered (see FIG. 5*b*) there is a sudden rise in emission and a subsequent drop. This occurs as cesium begins to adsorb on the electrode, causing a lowering of the surface work function below the bare value $\phi_o$. Thus, even though the temperature is dropping the emission can be increasing because of a work function variation. The maximum emission typically occurs at a fraction of a mono-layer coverage. As the temperature is lowered further there is additional cesium adsorption and the work function begins to rise toward that of bulk cesium. Thus finally, the emission drops as temperature is lowered. To see these effects in a more general way, the electron emission, pressure, and temperature for adsorbate emitters are typically related by "S-curves" such as those obtained by Taylor and Langmuir for the case of cesium on tungsten. Such curves with some more recent data by Houston are shown in FIG. 6, where the logarithm of current density is plotted versus the reciprocal temperature for various pressures. The arrival rate and cesium reservoir temperature are specified for each of the curves and sloping lines of constant work function $\phi$ are added to help interpret the data. These lines of constant work function are also lines of constant fractional surface coverage $\theta$. The $\theta$ values are given at the bottom of the figure. Thus, it can be seen that maximum current density occurs at about $\phi=1.8$ eV and $\theta=0.5$. More importantly, it can be seen from the figure that a current density of $J=0.1$ A/cm$^2$ could not be obtained with the W-Cs system with a cesium vapor pressure corresponding to $T_R=418°$ K., that is, $6.6\times10^{-3}$ Torr. Such S-curves occur for other vapors (barium and strontium, for example) and for other substrates. Thus, emission may vary depending on the particular pressures, vapors and substrate material as well as the temperature.

Another approach for lowering the work function is by the addition of barium or strontium vapors, either dispensed from within the electrodes or introduced through the vapor phase from a reservoir. The advantage of these vapors over the use of cesium for high emission is that the lowered work function can be accomplished with such low vapor pressures of the barium or strontium that the desired electrode work functions can be established without introducing a significant partial pressure in the plasma. Cesium will not adsorb significantly on a low work function barium or strontium surface at the temperatures which give the desired electron emission. Thus, the work function control and the plasma space neutralization roles become separated, to be optimized separately. Barium or strontium coverage on the electrode surfaces controls the electrode work functions; cesium pressure controls the space charge neutralization. This dual vapor optimization allows both pressures to be below the needed ($p \leqq 10^{-3}$ torr) to give high dielectric strength to the FCL interelectrode space. The use of cesium, barium and strontium in the FCL lowers work functions for the electrodes and allows operation at lower electrode temperatures which in turn lowers operating power requirements and extends the life of the device.

It is important to note that the plasma also introduces a second current limiting mechanism, the conduction limit of the fully ionized plasma, determined by the arrival rate of ions at the emitter surface. This limit occurs for the fully ionized plasma when the ion arrival rate is insufficient to neutralize the electron emission from the electrode surface acting at that moment as a cathode. Thus, an electron rich sheath barrier develops. Since the device is bidirectional, each surface exchanges role as emitter and collector every half cycle.

Figure 7:
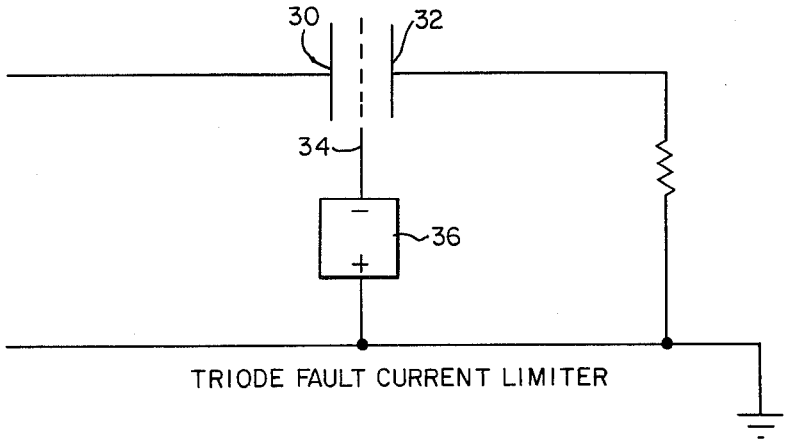
FIG. 7 is a fault current limiter triode shown in a circuit with means for grid biasing.
Figure 8:
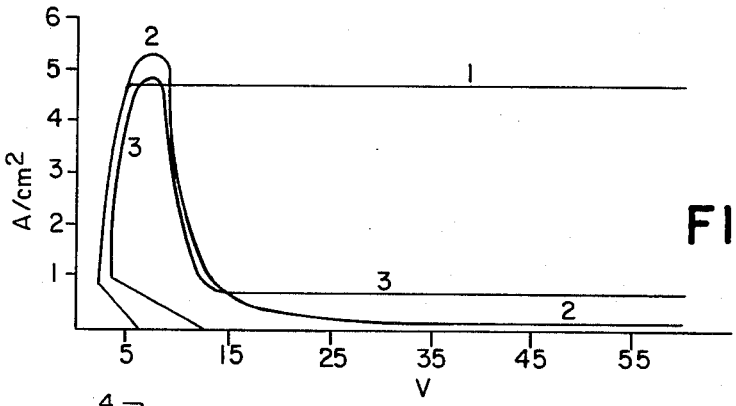
FIG. 8 is a plot of current-voltage characteristics showing current cut-off in a low pressure diode.
Figure 9:
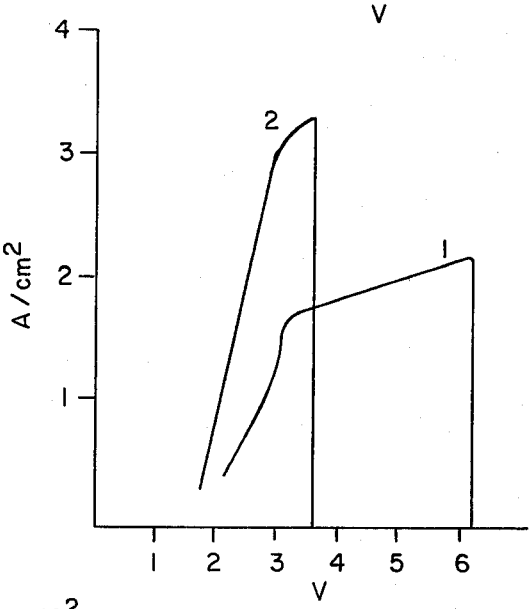
FIG. 9 is a plot of current-voltage characteristics showing current cut-off in a low pressure triode.

Actually, in a diode, if the electron emission is not quite neutralized by plasma ions there can be a cut-off as voltage and current increases so that thereafter, if voltage continues to increase, the current drops to low value. In other words, there is a current cut-off. The process is continuous and there are oscillations in the current as the cut-off begins to take effect. The same effect can occur in a triode as emitter to collector voltage increases, but in this case the cut-off is abrupt, with no steady-state operating points in the transition. A triode FCL is shown in FIG. 7. In FIG. 7, the plates 30 and 32 alternate as emitter and collector with the grid 34 positioned therebetween and biased by voltage source 36 to provide abrupt cut-off. These current voltage characteristics for a diode and a triode are shown in FIGS. 8 and 9.

Various mechanisms have been suggested for these spontaneous cut-off processes. The most plausible for the diode is that plasma waves are generated by the counter-flow of high energy electrons and ions causing a plasma resistance many orders of magnitude higher than normal. This may also be present in the triode, but in that case the critical process seems to be gas and ion depletion in the apertures of the grid. In both cases the process occurs when the gas becomes fully ionized and the device still encounters space charge problems. Plasma instabilities develop and in the triode there is also a heavy loss of ions to the grid due to the high fields and wall proximity in the apertures of the grid. The latter lead to high resistance, space charge limited flow of electrons through the grid. In both cases the discharge may go into a process of relaxation oscillations and extinguish, or go into an unignited mode. The current density at which cut-off occurs is the current density which can be neutralized by the full-ionization ion density, that is $$J_{critical} \approx \sqrt{\frac{M}{m}}\, J_{ion}. \tag{12}$$

Figure 10:
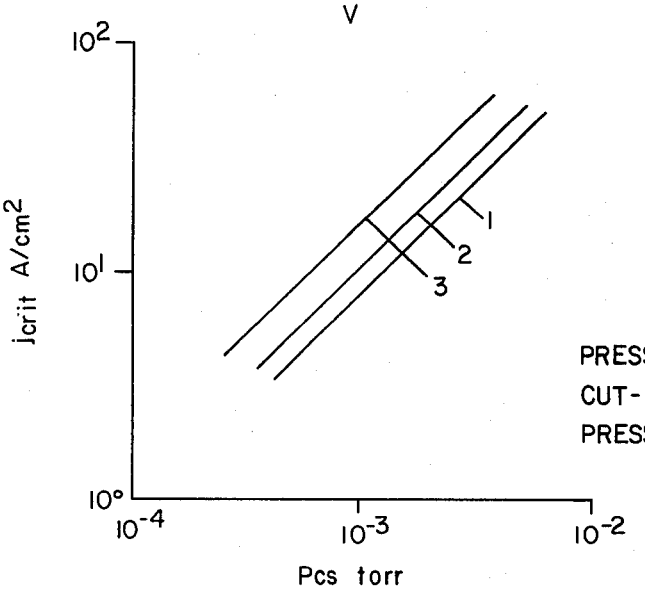
FIG. 10 is a plot of pressure vs cut-off current in a low pressure diode.

Thus, the cut-off current is proportional to the gas pressure as shown in FIG. 10 for a cesium plasma. When the gas is fully ionized the current is limited and further increase of voltage initiates instability and depletion effects, shutting off the discharge.

Whatever the mechanism, it means that the FCL can be used not only to limit current, but to cut-off current. The advantages of this for FCL use have already been mentioned. To obtain this added feature the FCL should be operated near the threshold for neutralization. This is about 0.1 A/cm$^2$ for P(Cs)$=10^{-5}$ torr and about 1.0 A/cm$^2$ for P(Cs)$=10^{-4}$ torr. As mentioned above, this can be achieved with both a diode and a triode embodiment. The triode embodiment has an added feature. For that case, if cut-off does not quite occur spontaneously it can be induced dynamically. That is, fast negative pulses can be used to make the cut-off processes more effective. In other words, if the device is operating near the cut-off threshold a fast negative pulse can effect cut-off. Thus, the FCL can limit current and also cut-off the current as desired.

The cut-off feature is important for the possibility it gives of eliminating the need for a separate circuit breaker. More important, however, is the fact that cut-off capability removes the power density restriction discussed earlier. Cut-off can be accomplished in microseconds. If the device can interrupt current say in 0.001 second (1/100 of the time anticipated for breakers and 1/100 of the value used in the current-densit-limitation calculations above), then a current density of 10 A/cm$^2$ could be used in the FCL. This greatly reduces the size and cost of the device.

This introduces a parameter of some practical significance. It means that there is an upper limit of current that can be switched for a given pressure. This is about 1 A/cm$^2$ for P(Cs)$=10^{-4}$ Torr and about 10 A/cm$^2$ for P(Cs)$=10^{-3}$ Torr. It also means that this is the pressure near which an FCL must be operated for complete grid control of the discharge since the effectiveness of the grid control is greatest near the critical point where the discharge already is nearly unstable. Thus, control of only 1 A/cm$^2$ becomes difficult because pressure must be in the $10^{-4}$ Torr range and cesium adsorption at that pressure is ordinarily not sufficient to give a low enough work function needed for 0.1 a/cm$^2$ emission. For this reason Cs-Ba combination can be used in these applications—the barium provides the low work function, the cesium provides the plasma.

Finally, since the low work function of the emitter adsorption surface occurs due to a continuously evaporating and condensing layer, the result of both the bare metal work function and the vapor phase over it, the emitting surface is self-rejuvenating. It is not subject to permanent bombardment damage and thus has an indefinite life. This ability makes it practical to use the electrodes both as emitters and collectors, with both electrodes at the same temperature. This symmetry of design permits use of only one device to accommodate current flow in both directions in each power line, rather than two devices back-to-back. The use of an isothermal device also greatly reduces operating power requirements.

There is one potential advantage, however, to a nonisothermal device. By using a temperature difference between the electrodes, it is possible to have electrode work function differences compensate for internal voltage drops and have the device conduct current with reduced overall voltage drop. This would be important for in-line fault current limiters.

REDUCTION TO PRACTICE

Figure 11:
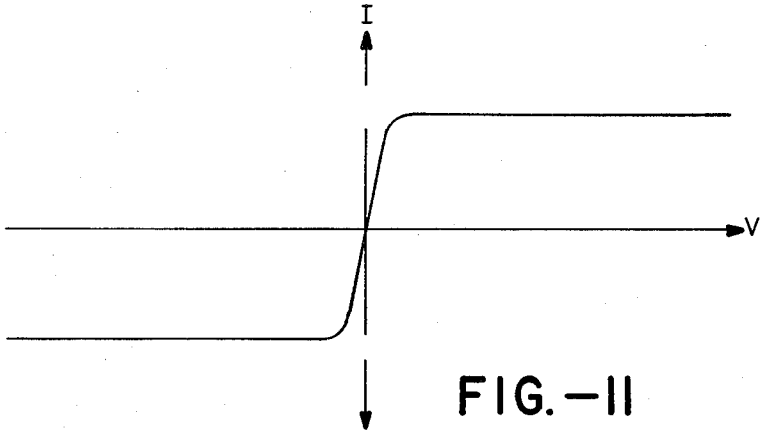
FIG. 11 is a plot of the current-voltage characteristic of a thermionic-plasma fault current limiter.
Figure 12:
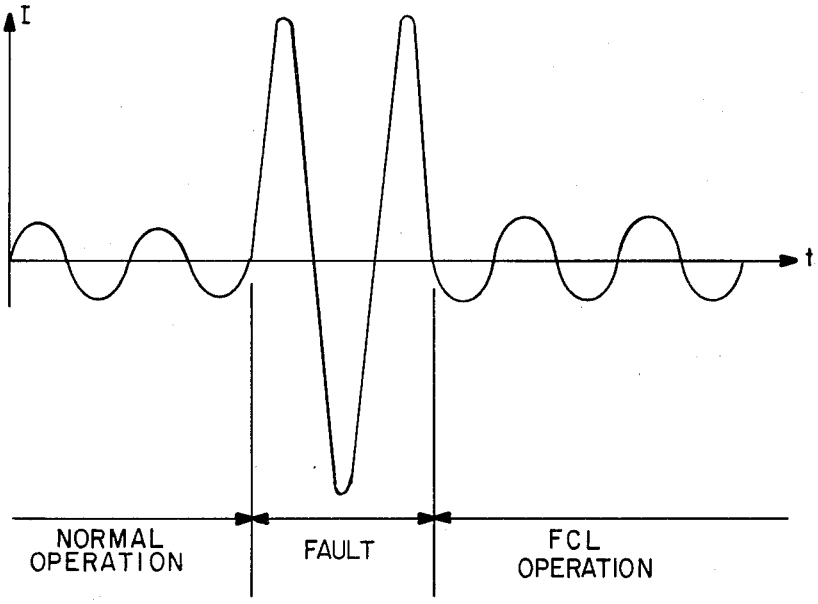
FIG. 12 is a plot of current vs time illustrating the action of a fault current limiter.

Plasma thermionic fault current limiters constructed in accordance with the teachings of this invention were successfully operated and demonstrated a high voltage capability as well as the expected saturation characteristics at low operating temperature. Using an interelectrode spacing of 0.25 cm, electrode temperature was near 900° K., and cesium vapor pressure was $8\times10^{-3}$ torr, one device operated at a current density of 0.01 to 0.05 A/cm$^2$, reaching first peak currents at voltages as low as 5 volts applied. The device kept the current within a factor of two of the first peak with up to 500 volts applied and a voltage ratio of 100. The operating characteristics of this fault current limiter are shown in FIGS. 11 and 12. The device operated at an acceptable current density and also showed 2 kV standoff voltage between the two electrodes.

Figure 13B:
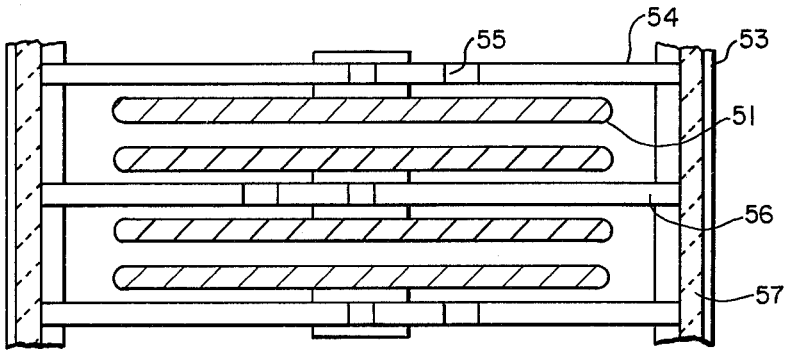
FIG. 13*b* is an enlarged view of a portion of the device of FIG. 13*a*.
Figure 13A:
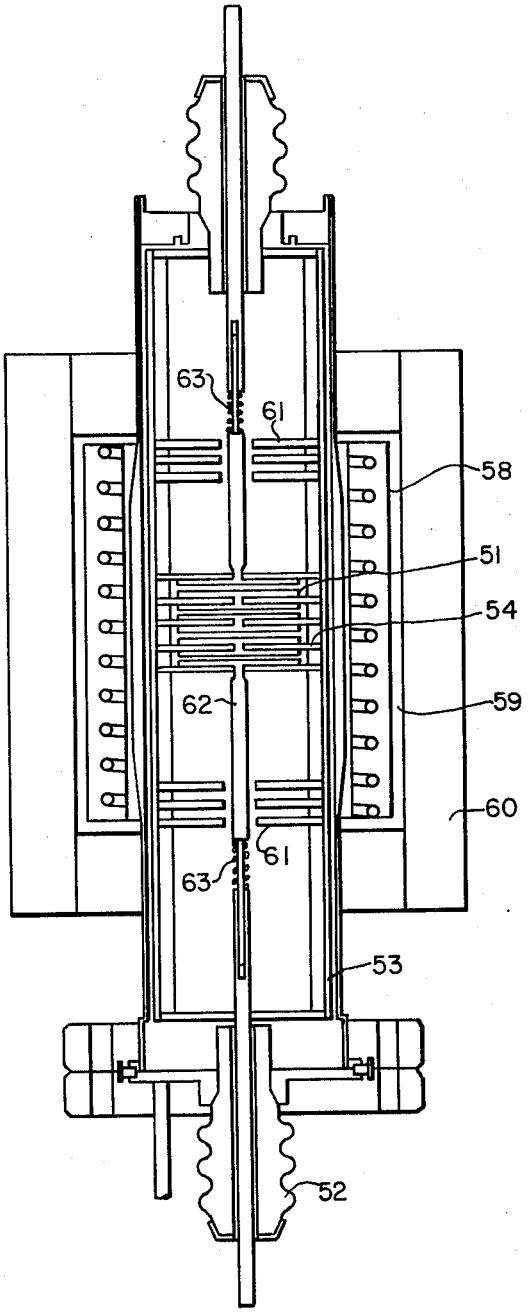
FIG. 13*a* is a cross-sectional view of another embodiment of the invention.

Another configuration of the FCL is shown in the cross-sectional view in FIG. 13*a*, and in the enlarged sectional view of FIG. 13*b*. A series of electrodes 51 are connected through high voltage insulator feedthroughs 52 at the ends of a nickel tube 53. The electrodes 51 are mounted on ceramic support spacers 54 that have vapor communicating holes 55 (as shown in FIG. 13*b*) and are spaced by ceramic rings 56 inside a ceramic tube 57.

Surrounding the nickel tube 53 is a heater 58 inside of a high temperature thermal insulation 59 which is inside thermal insulation 60. Radiation shields 61 at both ends serve to further reduce heat loss. Electrode contactors 62 are spring loaded by springs 63 to make good electrical connection to the electrodes 51.

As shown in FIG. 13*b*, the electrodes 51 are arranged so that sputtered metal from the electrode emitting surfaces do not deposit on most of the ceramic support spacer. This minimizes surface breakdown problems between electrodes. Thus, the electrodes themselves function as sputtering shadow shields for the insulator. There may also be a problem of material from dispensing electrodes. If dispensing electrodes were used, the back-side of the electrodes could be sealed by a high temperature braze or an additional nondispensing plate so the dispensing material will not go directly on to the ceramic spacers. Although the electrodes themselves are functioning here as shadow-shields, alternatively shadow shields could also be supplied as an extra member as is conventional in vacuum interrupters. The design shown in FIG. 13*a* and 13*b*, also gives a field free region between the two halves of an electrode to diminish breakdown problems along the ceramic surfaces. The successful operation of this device demonstrates the feasibility of operating plasma thermionic cells in series in order to limit current in very high voltage lines.

While the invention has been described with reference to a specific embodiment, the description is illustrative of the invention and is not to be cofnstrued as limiting the invention. For example, the electrodes have been described as comprising plates; however, other electrode configurations such as cylinders, cones, and the like can be employed. Thus, various modifications and applications may occur to those skilled in the art without departing from the true spirit and scope of the invention as defined by the appended claims.

What is claimed is:

1. A thermionic fault current limiter comprising a vacuum tight enclosure, a plurality of conductive electrodes, means for insulatively supporting said electrodes in said enclosure in generally spaced alignment, a first electrical conductor insulatively mounted through said housing and in contact with a first of said electrodes, a second electrical conductor insulatively mounted through said enclosure and in contact with another of said electrodes, and heater means for heating said electrodes.

2. A thermionic fault current limiter as defined by claim 1 and further including an outer housing which is electrically insulated from said electrodes whereby said housing is maintained at ground potential during operation.

3. A thermionic fault current limiter as defined by claim 1 or 2 wherein said conductive electrodes comprise plates, said plates of each electrode being spaced in generally parallel alignment with plates of other electrodes whereby energy absorbed under fault conditions is distributed through the bulk of the material of said electrodes.

4. A thermionic fault current limiter as defined by claim 3 and further including a plurality of ceramic spacer means, first and second electrically interconnected conductive plates supportedly mounted on opposing sides of each ceramic spacer means, and support means for maintaining said plurality of ceramic spacer means in spaced parallel alignment with two conductive plates between pairs of ceramic spacers being insulatively spaced.

5. A thermionic fault current limiter as defined by claim 4 wherein each ceramic spacer includes passage means for establishing a uniform environment about said conductive plates, said first and second conductive plates defining equipotential surfaces about said passage means.

6. A thermionic fault current limiter as defined by claim 5 wherein said support means comprises a plurality of ceramic discs with each ceramic disc positioned between two electrically interconnected conductive plates, and a ceramic tube, said ceramic washers and said ceramic discs engaging the inner surface of said ceramic tube.

7. A thermionic fault current limiter as defined by claim 5 wherein said environment is a vacuum.

8. A thermionic fault current limiter as defined by claim 2 wherein the spacing of said two adjacent electrodes is defined by $$\frac{V_m/N}{7\times10^6(\ln F)^2} \leqq d \leqq \left[\frac{2.33\times10^{-6}(V_s/N)^{3/2}}{J}\right]^{\frac{1}{2}}$$

where

J is the current density $\epsilon$ is the permittivity of free space, e is the charge of an electron, m is the mass of an electron, $V_s$ is the initial surge voltage when the device first starts to limit the fault current, N is the number of cells (electrode pairs) in series in the device, d is the interelectrode spacing, A is a constant characteristic of the emitting surface,
T is the absolute temperature of the emitter,
o is the work function of the emitter,
E is the electric field at the emitter,
k is the Boltzmann constant.

9. A thermionic fault current limiter as defined by claim 2 wherein said environment includes a plasma.

10. A thermionic fault current limiter as defined by claim 7 wherein said plasma is provided by a vaporizable alkalai metal, and further including a reservoir for containing said vaporizable alkalai material.

11. A thermionic fault current limiter as defined by claim 7 wherein said plasma is provided by an alkali metal, said alkalai metal being a part of said electrodes.

12. A thermionic fault current limiter as defined by claim 11 wherein said heater means provides a temperature difference between adjacent electrodes whereby accumulated contact potential difference of an electrode pair reduces overall voltage drop.

13. A thermionic fault current limiter as defined by claim 1 and further including grid means between adjacent electrodes and means for biasing said grid means to accelerate the extinction of current between said adjacent electrodes.

14. A plasma thermionic fault current limiter comprising a housing, a plurality of conductive electrodes, means for insulatively supporting said electrodes in said housing in generally spaced alignment, a first electrical conductor insulatively mounted through said housing and in contact with a first of said electrodes, a second electrical conductor insulatively mounted through said housing and in contact with a second of said electrodes, vaporizable material within said housing, and heater means for heating said electrodes and vaporizing said material.

15. A plasma thermionic fault current limiter as defined by claim 14 wherein said material is selected from the group consisting of barium, strontium, and cesium.

16. A plasma thermionic fault current limiter as defined by claim 14 wherein said heater means establishes a temperature gradient along said plurality of conductive electrodes.

17. A plasma thermionic fault current limiter as defined by claim 14 wherein said means for insulatively supporting said electrodes comprises insulator spacers between said electrodes.

18. A plasma thermionic fault current limiter as defined by claim 17 wherein said insulator spacers comprise alumina.

19. A plasma thermionic fault current limiter as defined by claim 14 and further including reservoir means within said housing for containing said vaporizable material.

20. A plasma thermionic fault current limiter as defined by claim 16, 17, 18, or 19 wherein fault current is reduced to zero and said fault current limiter comprises a circuit breaker.

21. In a thermionic emission fault current limiter including a housing and a plurality of electrodes therein, a method of reducing as well as limiting fault currents comprising the step of thermal desorption of adsorbed gas on the electrodes whereby said electrodes emit less current.

22. In a thermionic emission fault current limiter including a housing and a plurality of electrodes therein, a method of reducing as well as limiting fault currents comprising the step of reducing the plasma density so space charge instabilities obstruct the inter-electrode current.

* * * * *